US008331837B2

(12) United States Patent
Tanaka et al.

(10) Patent No.: US 8,331,837 B2
(45) Date of Patent: Dec. 11, 2012

(54) IMAGE-FORMING DEVICE WITH SUPPORT MEMBER SUPPORTING TRANSFER ROLLER AND DELIVERY ROLLER

(75) Inventors: Shinichi Tanaka, Nagano (JP); Satoshi Chiba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/114,709

(22) Filed: May 24, 2011

(65) Prior Publication Data

US 2011/0318068 A1 Dec. 29, 2011

(30) Foreign Application Priority Data

Jun. 29, 2010 (JP) ..... 2010-147195

(51) Int. Cl.
*G03G 15/01* (2006.01)

(52) U.S. Cl. ..... 399/304; 399/121; 399/297; 399/316; 399/388

(58) Field of Classification Search ..... 399/121, 399/297, 304, 316, 388
See application file for complete search history.

(56) References Cited

U.S. PATENT DOCUMENTS

| | | | | |
|---|---|---|---|---|
| 3,612,677 | A * | 10/1971 | Langdon et al. | 399/304 |
| 6,389,242 | B1 | 5/2002 | Watanabe | |
| 2009/0190979 | A1 * | 7/2009 | Tanaka | 399/397 |
| 2010/0031837 | A1 | 2/2010 | Feygelman et al. | |

FOREIGN PATENT DOCUMENTS

| | | | |
|---|---|---|---|
| JP | 2002-156839 | A | 5/2002 |
| JP | 2006-513883 | T | 4/2006 |
| WO | WO-2004/067277 | A1 | 8/2004 |

* cited by examiner

*Primary Examiner* — Ryan Walsh
(74) *Attorney, Agent, or Firm* — Global IP Counselors, LLP

(57) ABSTRACT

An image-forming device comprising: an image-carrier belt that carries an image; a belt-driving roller that causes the image-carrier belt to move, the image-carrier belt being engaged around the belt-driving roller; a tension roller that applies a tension to the image-carrier belt, the image-carrier belt being engaged around the tension roller; a transfer roller having a concaved portion and a gripper, the transfer roller coming into contact with the tension roller interposed by the image-carrier belt, and transferring the image that is carried by the image-carrier belt onto the transfer material; a contacting/diverging part that causes the tension roller to move and that causes the transfer roller and the image-carrier belt to come into contact with or diverge from one another; a delivery part that delivers the transfer material that is gripped by the gripper; and a support member that pivotally supports the transfer roller and supports the delivery part.

5 Claims, 9 Drawing Sheets

IMAGE-FORMING DEVICE WITH SUPPORT MEMBER SUPPORTING TRANSFER ROLLER AND DELIVERY ROLLER

CROSS-REFERENCE TO RELATED APPLICATIONS

This application claims priority to Japanese Patent Application No. 2010-147195 filed on Jun. 29, 2010. The entire disclosure of Japanese Patent Application No. 2010-147195 is hereby incorporated herein by reference.

BACKGROUND

1. Technical Field

The present invention relates to an image-forming device and an image-forming method relating to electronic photographs.

2. Background Technology

There has been disclosed an image-forming device for gripping and releasing a transfer material using a gripper provided in a concaved portion of a transfer roller. Japanese Patent Application Publication No 2006-513883 (Patent Citation 1) is an example of such image-forming device. However, for the image-forming device according to Patent Citation 1, there is no mention of impact or vibration at the position at which a switch is performed between a state in which the concaved portion of the transfer roller is opposite the image carrier and a state in which a region of the transfer roller other than the concaved portion is in contact with the image carrier.

There has also been disclosed an image-forming device relating to a transfer part for pressing a transfer roller onto an image carrier using a pressing member. Japanese Patent Application Publication No. 2002-156839 (Patent Citation 2) is an example of such image-forming apparatus.

SUMMARY

Problems to Be Solved by the Invention

In an instance in which a transfer having a concaved portion, such as that shown in Patent Citation 1, is pressed onto an image carrier using a pressing member as shown in Patent Citation 2, there is a risk of a large impact or vibration occurring at the position at which a switch is performed between a state in which the concaved portion of the transfer roller is opposite the image carrier and a state in which an outer periphery of the transfer roller other than the concaved portion is in contact with the image carrier, and other positions, affecting the gripping of the transfer material by the gripper or the forming of the image.

An object of the invention is to provide an image-forming device and an image-forming method in which delivering of a transfer material from a delivery roller to a transfer roller is performed in a stable manner, the transfer material is accurately gripped by a gripper, and an image is thereby formed in a satisfactory manner.

Means Used to Solve the Above-Mentioned Problems

An image-forming device according to the invention includes an image-carrier belt for carrying and transporting an image;

a belt-driving roller for causing the image-carrier belt to move, the image-carrier belt being engaged around the belt-driving roller;

a tension roller for stretching the image-carrier belt, the image-carrier belt being engaged around the tension roller;

a transfer roller having a concaved portion and a gripper, the concaved portion being formed on a peripheral surface, the gripper being provided in the concaved portion and adapted for gripping a transfer material, the transfer roller coming into contact with the tension roller interposed by the image-carrier belt, and transferring the image that is carried by the image-carrier belt onto the transfer material;

a contacting/diverging part that causes the tension roller to move and that causes the transfer roller and the image-carrier belt to come into contact with or diverge from one another;

a delivery part for delivering the transfer material that is gripped by the gripper; and a support member for pivotally supporting the transfer roller and supporting the delivery part.

The image-forming device also has a transporting part for transporting the transfer material onto which the image has been transferred by the transfer roller, wherein the support member supports the transporting part.

The transporting part also has an airflow generating part for generating an airflow, and a suction guide part for using the airflow generated by the airflow generating part to suction the transfer material and guide the transfer material.

The transporting part also has a transporting belt for using airflow to suction and transport the transfer material that has been guided by the suction guide part; and a transporting belt tension roller for stretching the transporting belt, the transporting belt tension roller being supported by the support member.

The image-forming device also includes an adjusting part having a cylindrical member and a contact member, the cylindrical member being supported coaxially with respect to a rotation shaft of the tension roller, the contact member being provided at an end part of the transfer roller in an axial direction and coming into contact with the cylindrical member, wherein the adjusting part adjusts the distance between the tension roller and the transfer roller using contact between the cylindrical member and the contact member.

An image-forming method according to the invention includes delivering a transfer material using a delivery part that is supported by a support member;

gripping the delivered transfer material using a gripper provided to a concaved portion of a transfer roller supported by the support member;

causing the transfer roller to rotate, causing a tension roller that applies a tension to a image-carrier belt to move, and that causes the transfer material to move into a transfer nip, the transfer nip being formed by the transfer roller coming into contact with the image-carrier belt; and transferring an image that is carried by the image-carrier belt onto the transfer material.

Also, the transfer material, onto which the image has been transferred in the transfer nip, is supported by the support member, suctioned by airflow, and guided.

According to the invention, the transfer roller having the gripper for gripping the transfer material and the delivery part for delivering the delivery part are supported by the same support member, whereby the positional relationship between the transfer roller and the delivery part remains unchanged. Therefore, displacement in the transport path of the transfer material is reduced, incidence of the transfer material falling between the delivery part and the transfer roller due to grip failure or another cause is reduced, delivery is performed in a stable manner, the transfer material is accurately gripped at the gripper, and it is thereby made possible to form an image in a satisfactory manner.

Also, the transporting part for transporting the transfer material that has diverged from the transfer roller is supported by the same support member as the transfer roller and the delivery part, whereby the positional relationship between the transfer roller and the transport path remains unchanged. Therefore, displacement in the transportation path of the transfer material is reduced, incidence of the transfer material jamming, falling, or otherwise suffering a fault between the delivery part and the transporting part due to grip failure or another cause is reduced, delivery and transporting is performed in a stable manner, and it is thereby made possible to form an image in a satisfactory manner.

It also becomes possible for the transporting part to use airflow to suction an image surface of the transfer material, and to transport the transfer material in a stable manner without disrupting the image. Also, it becomes possible to transport the transfer material in an even more stable manner using the transporting belt.

Also, providing the contact member, or the contact member and the cylindrical member, makes it possible to perform a positional adjustment between the transfer roller and the tension roller, and thereby prevent the gripper and the image-carrier belt from touching each other.

DETAILED DESCRIPTION OF EXEMPLARY EMBODIMENTS

An embodiment of the invention will now be described with reference to the accompanying drawings.

Figure 1:
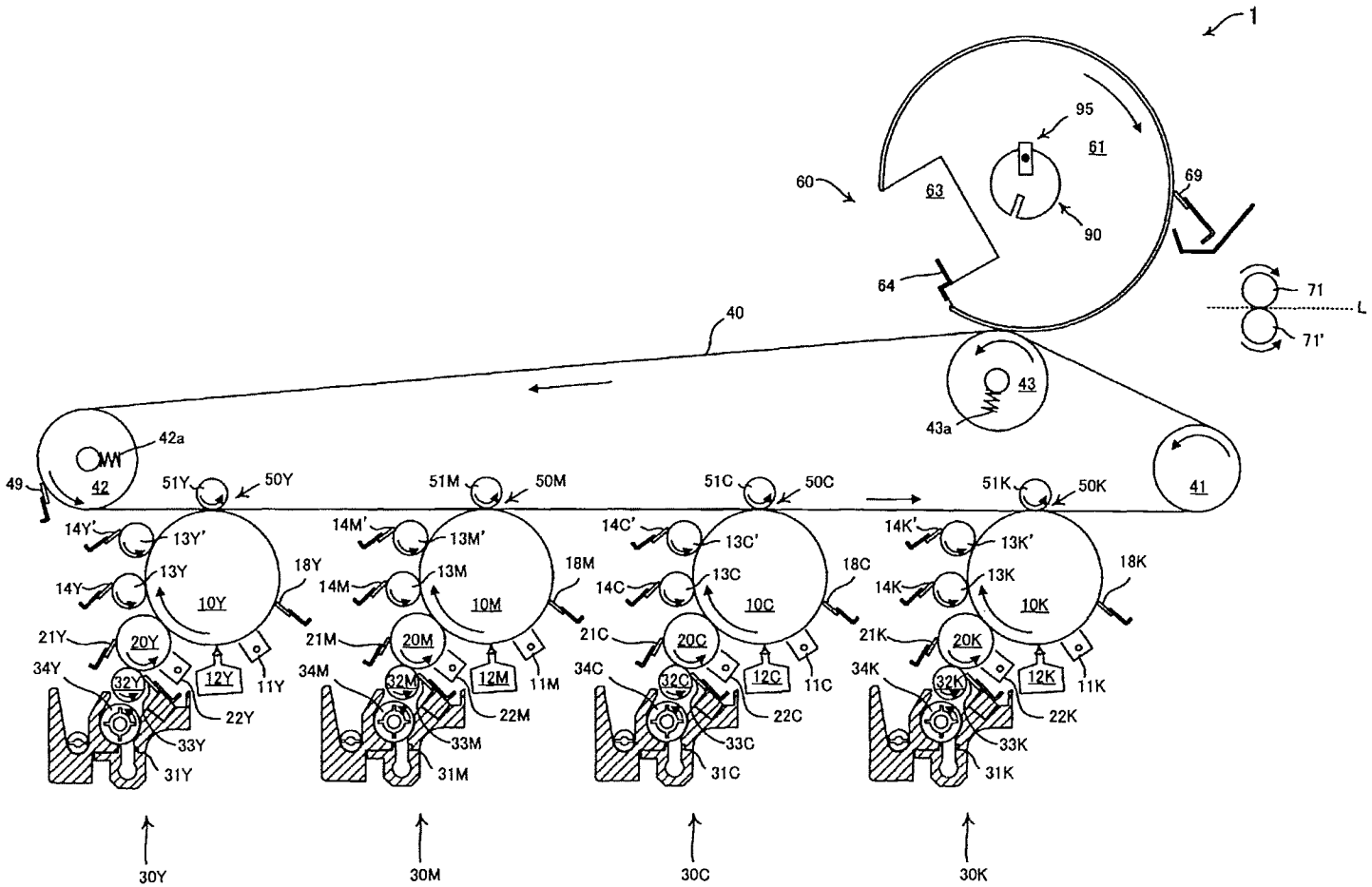
FIG. 1 is a drawing showing main constituent elements forming an image-forming device according to an embodiment of the invention.

FIG. 1 is a drawing showing main constituent elements forming an image-forming device according to an embodiment of the invention. In relation to an intermediate transfer belt 40, which is an image carrier, disposed at a center part of the image-forming device, developing devices 30Y, 30M, 30C, 30K, which are developing parts, are arranged downward in the perpendicular direction of the image-forming device, and a secondary transfer part 60, which is a transfer part; a fixing unit (not shown); and other structures are arranged upward in the perpendicular direction of the image-forming device.

The surroundings of photoreceptors 10Y, 10M, 10C, 10K, which are latent image carriers on which a latent image is formed, include corona chargers 11Y, 11M, 11C, 11K as charging parts; LED arrays or other exposure units 12Y, 12M, 12C, 12K as exposure parts; and other devices in order to form an image using a toner. The corona chargers 11Y, 11M, 11C, 11K cause the photoreceptors 10Y, 10M, 10C, 10K to be uniformly charged; the exposure units 12Y, 12M, 12C, 12K perform exposure according to an inputted image signal; and an electrostatic latent image is formed on the charged photoreceptors 10Y, 10M, 10C, 10K.

In brief, the developing devices 30Y, 30M, 30C, 30K include development rollers 20Y, 20M, 20C, 20K as developer carriers; developer containers (reservoirs) 31Y, 31M, 31C, 31K for storing developers for each of the colors yellow (Y), magenta (M), cyan (C), and black (K); anilox rollers 32Y, 32M, 32C, 32K, as developer feeding members, which are application rollers for applying the developer for each of the colors from the developer containers 31Y, 31M, 31C, 31K onto the development rollers 20Y, 20M, 20C, 20K; and other components; and develop the electrostatic latent image formed on the photoreceptors 10Y, 10M, 10C, 10K using the developer for each of the colors.

The intermediate transfer belt 40 is a belt formed from a seamless rubber or a similar material; stretched by a belt-driving roller 41, a driven roller 42, and a tension roller 43 as a tension roller; and rotatably driven by the belt-driving roller 41 while caused to come into contact with the photoreceptors 10Y, 10M, 10C, 10K at primary transfer parts 50Y, 50M, 50C, 50M. Primary transfer rollers 51Y, 51M, 51C, 51K are disposed opposite the primary transfer parts 50Y, 50M, 50C, 50K with the photoreceptors 10Y, 10M, 10C, 10K and the intermediate transfer belt 40 interposed therebetween. The primary transfer parts 50Y, 50M, 50C, 50K sequentially layer and transfer the developed toner image of each color on the photoreceptors 10Y, 10M, 10C, 10K onto the intermediate transfer belt 40, and form a full-color toner image, with positions of contact with the photoreceptors 10Y, 10M, 10C, 10K being transfer positions.

A cleaning part including a transfer belt cleaning blade 49 is disposed so as to come into contact with a location at which the intermediate transfer belt 40 is stretched by the driven roller 42, so that any remaining toner and carrier on the intermediate transfer belt 40 are cleaned off.

The secondary transfer part 60 includes a secondary transfer roller 61, as a transfer roller, and other components. The secondary transfer roller 61 is caused to rotate, with the rotation of the tension roller 43, in a direction indicated by the arrow and subjected to a transfer bias, whereby the toner image on the intermediate transfer belt 40 is transferred, in the transfer nip, onto a paper sheet, a film, a cloth, or another transfer material transported along a transfer material transport path L. The secondary transfer part 60 also has a transfer roller cleaning blade 69 for cleaning the secondary transfer roller 61, and other components.

A transfer material transporting part 80 is arranged downstream of the secondary transfer part 60 on the transfer material transport path L so as to transport the transfer material to a fixing unit (not shown). In the fixing unit 90, the monochromatic toner image or the full-color toner image transferred onto the paper sheet or another transfer material is sealed and fixed onto the paper sheet or another transfer material.

Feeding of the transfer material into the image-forming device is performed by a paper-feeding device (not shown). The transfer material that has been positioned in the paper-feeding device is fed into the transfer material transport path L, one sheet at a time, at a predetermined timing. In the transfer material transport path L, the transfer material is transported to a secondary transfer nip position by gate rollers 71, 71', which constitute a delivery part, and the developed monochromatic toner image or the developed full-color toner image formed on the intermediate transfer belt 40 is transferred onto the transfer material.

As described above, the transfer material that has undergone secondary transfer is further transported to the fixing unit by the transfer material transporting part 80. The fixing unit includes a heating roller (not shown) and a pressure-applying roller (not shown), which is urged towards the heating roller at a predetermined pressure. The fixing unit passes the transfer material through a nip between the heating roller and the pressure-applying roller, and seals and fixes the monochromatic toner image or the full-color toner image, which has been transferred onto the transfer material, onto the paper sheet or another transfer material.

A description will now be given for the developing devices. Since the configuration of the part around the photoreceptor and of the developing device for each of the colors is identical, a description will be given for the photoreceptor and the developing device for yellow (Y).

In the part around the photoreceptor, using the corona charger 11Y as a reference, the exposure unit 12Y, the development roller 20Y of the developing device 30Y, a first photoreceptor squeeze roller 13Y, a second photoreceptor squeeze roller 13Y', the primary transfer part 50Y, a neutralization part (not shown), and a photoreceptor cleaning blade 18Y are disposed along a direction of rotation of an outer circumference of the photoreceptor 10Y. With regards to the image-forming process, structures disposed in upstream stages in sequence from the corona charger 11Y to the photoreceptor cleaning blade 18Y are defined as being upstream relative to structures disposed in later stages.

The photoreceptor 10Y is a photoreceptor drum including a cylindrical member with an amorphous silicon photoreceptor or another photoreceptor layer formed on the outer circumferential surface. The photoreceptor 10Y rotates in the clockwise direction in FIG. 1.

The corona charger 11Y is disposed upstream in the direction of rotation of the photoreceptor 10Y from the nip part between the photoreceptor 10Y and the development roller 20Y; a voltage is applied from a power source unit (not shown), and the photoreceptor 10Y is charged with a corona discharge. The exposure unit 12Y is disposed downstream from the corona charger 11Y, and upstream of the nip part formed with respect to the development roller 20Y, in the direction of rotation of the photoreceptor 10Y. The exposure unit 12Y emits light onto the photoreceptor 10Y that has been charged by the corona charger 11Y, and forms a latent image on the photoreceptor 10Y.

The developing device 30Y includes the development roller 20Y for carrying the developer; the anilox roller 32Y, which is an application roller for applying the developer onto the development roller 20Y; a regulation blade 33Y for regulating the amount of developer applied onto the development roller 20Y; an auger 34Y for feeding the developer to the anilox roller 32Y while stirring and transporting the developer; a compaction corona generator 22Y for placing the developer carried by the development roller 20Y into a state of compaction; a development roller cleaning blade 21Y for cleaning the development roller 20Y; and the developer container 31Y for storing the developer in a state in which the toner is dispersed within the carrier at a weight ratio of approximately 20%.

The developer held in the developer container 31Y is a non-volatile developer that is non-volatile at normal temperatures and has a high concentration and high viscosity, rather than being a volatile developer that has Isopar (an Exxon brand) as its carrier, is volatile at normal temperatures, has a low concentration (approximately 1 to 3 wt %), and has a low viscosity, as has generally been used. Specifically, the developer in the invention is a developer that has a high viscosity (i.e., has a viscoelasticity of approximately 30 to 300 mPa·s at a shear rate of 1000 (1/s) at 25° C., as measured using a HAAKE RheoStress RS600), and has a toner solids concentration of approximately 15 to 25%, wherein solid particles of a pigment or another colorant dispersed within a thermoplastic resin are added to an organic solvent, a silicone oil, a mineral oil, a cooking oil, or another liquid solvent along with a dispersant, the solid particles having an average particle diameter of 1 μm.

The sequence in which photoreceptors, developing devices, and other members corresponding to each of the colors Y, M, C, K are arranged is not limited by the example shown in FIG. 1, and can be set as desired.

Figure 2:
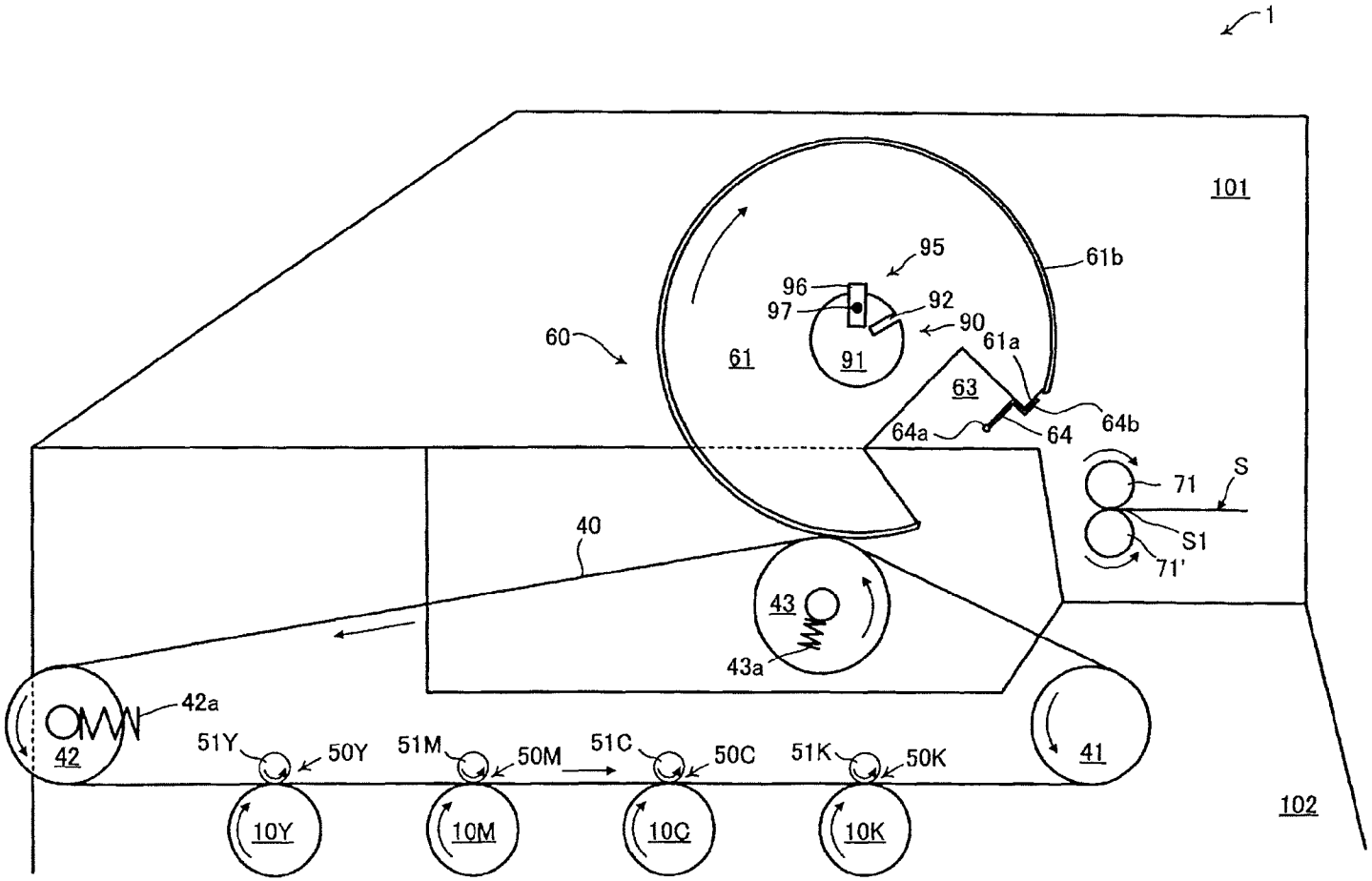
FIG. 2 is a drawing showing a state in which the outer circumference of a secondary transfer roller and a tension roller are in contact with each other according to a first embodiment.
Figure 3:
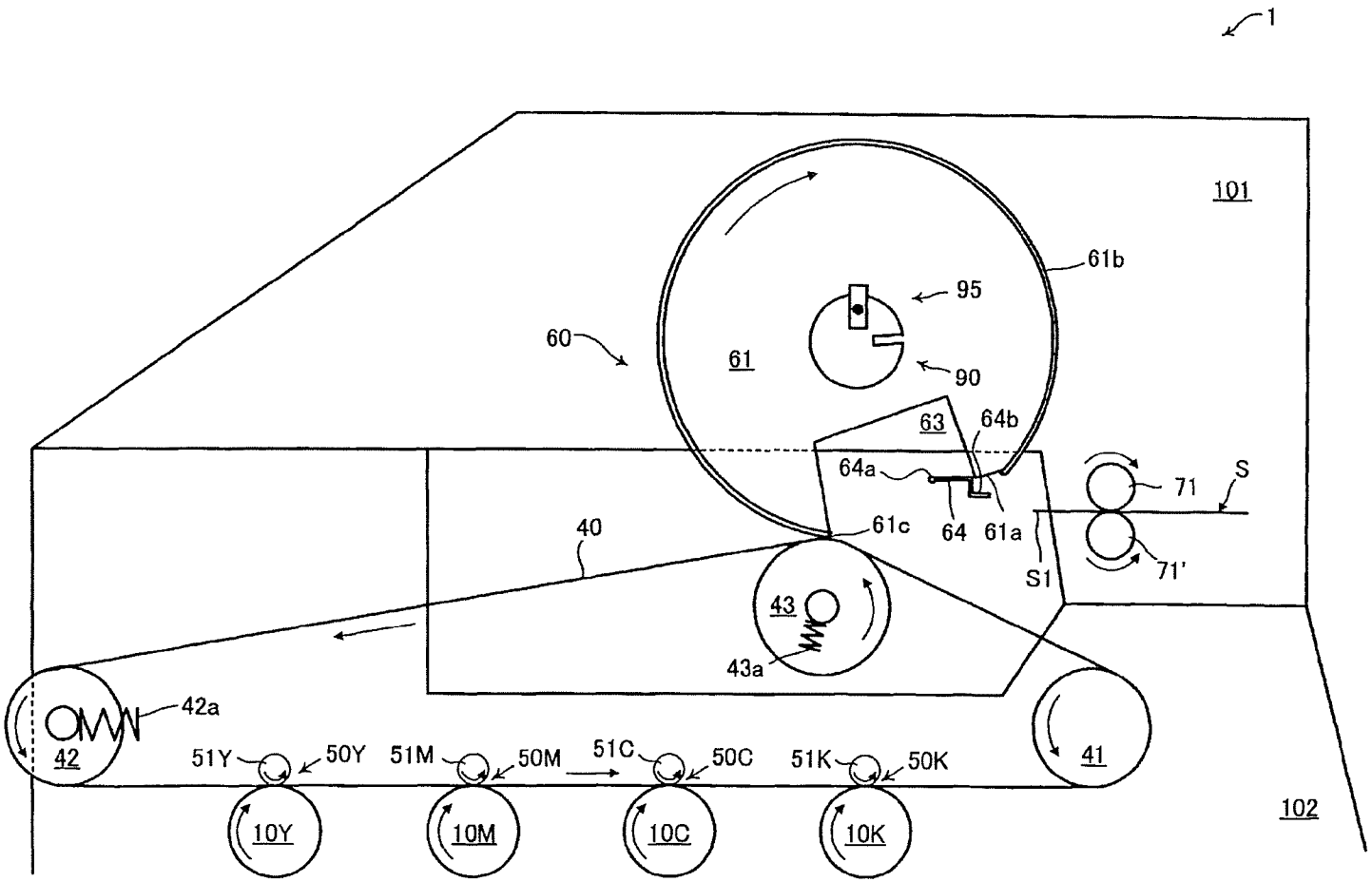
FIG. 3 is a drawing showing a state in which a first boundary of the secondary transfer roller and the tension roller are in contact with each other according to the first embodiment.
Figure 4:
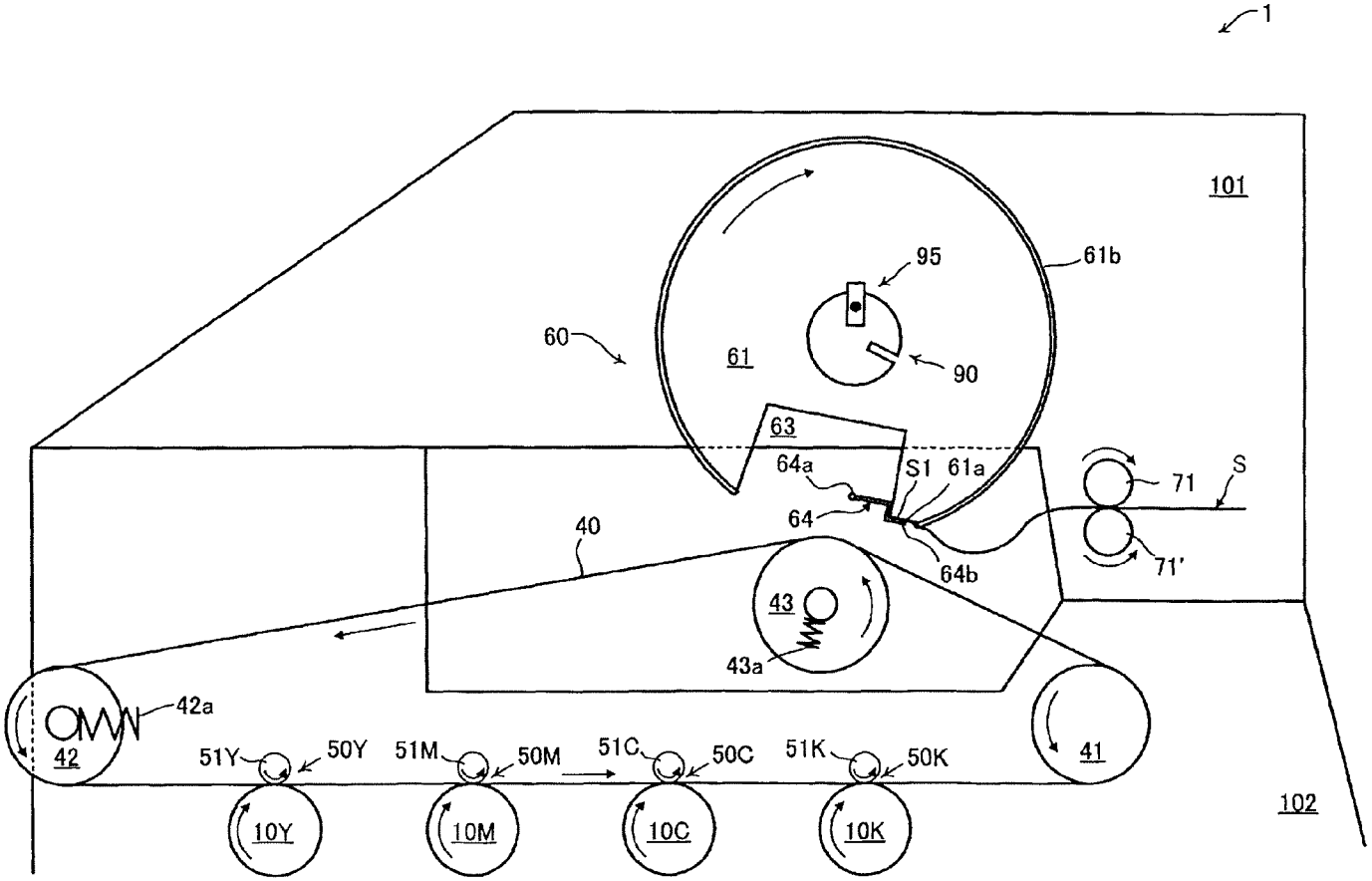
FIG. 4 is a drawing showing a state in which a concaved portion of the secondary transfer roller and the tension roller are opposite each other according to the first embodiment.
Figure 5:
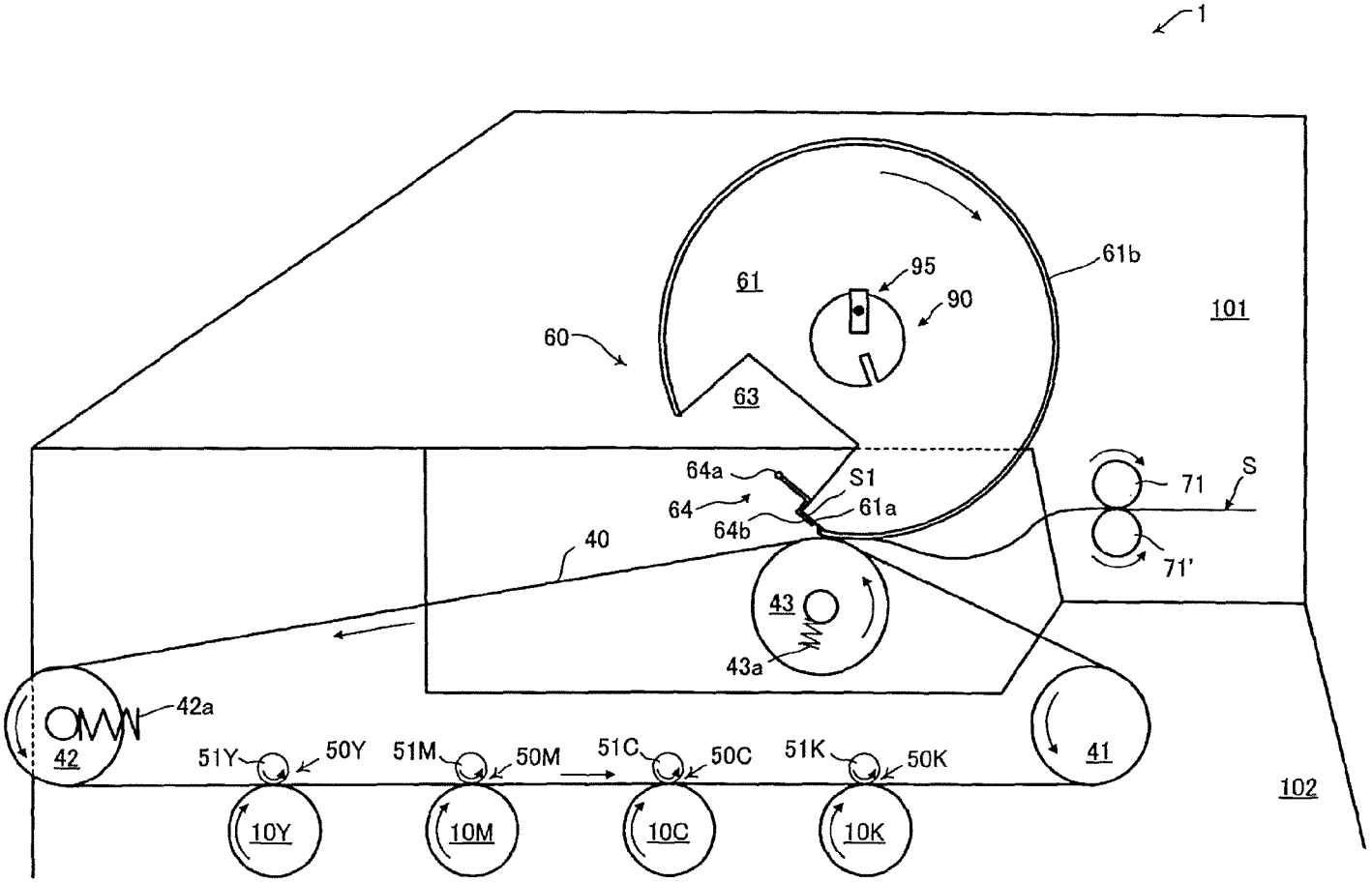
FIG. 5 is a drawing showing a state in which a second boundary of the secondary transfer roller and the tension roller are in contact with each other according to the first embodiment.

A configuration of the secondary transfer part 60 and other components according to the first embodiment will now be described. FIGS. 2 through 5 are expanded views showing the vicinity of the secondary transfer part 60 according to the first embodiment. FIG. 2 is a drawing showing a state in which an outer circumference 61*b* of the secondary transfer roller 61 and the tension roller 43 are in contact with each other; FIG. 3 is a drawing showing a state in which a first boundary 61*c* of the secondary transfer roller 61 and the tension roller 43 are in contact with each other; FIG. 4 is a drawing showing a state in which a concaved portion 63 of the secondary transfer roller 61 and the tension roller 43 are opposite each other; and FIG. 5 is a drawing showing a state in which a second boundary 61*d* of the secondary transfer roller 61 and the tension roller 43 are in contact with each other.

The secondary transfer roller 61 has a concaved portion 63 on a cylindrical main body. The concaved portion 63 is provided so as to extend in the axial direction of the secondary transfer roller 61. A gripper 64, which is a gripping member; and a gripper support part 61*a*, which is a gripping member support part on which the gripper 64 lands, are provided in the concaved portion 63. The gripper 64 and the gripper support part 61*a* form a gripper.

The gripper 64 is provided along the axial direction of the secondary transfer roller 61, and may be provided in any desired quantity. Each of the grippers 64 is provided so as to rotate relative to a rotation shaft 64*a*, and so that the gripper 64*b* lands on the gripper support part 61*a*. The gripper support part 61*a* is formed by machining the main body of the secondary transfer roller 61 at an end part in the circumferential direction on the side towards the rear, in the direction of rotation, of the concaved portion 63 of the secondary transfer roller 61. In the present embodiment, each of the gripper 64*b* and the gripper support part 61*a* is configured by a flat surface. The gripper support part 61*a* may be configured by a member that is separate to the main body of the secondary transfer roller 61.

The circumferential length of the secondary transfer roller 61 is set so as to be greater than the length, in the direction of movement of the transfer material, of the transfer material S that, out of the types of the transfer material S used in the image-forming device 1 according to this example, has the largest length in the direction of movement of the transfer material. More specifically, the circumferential length of the secondary transfer roller 61, not including the width of the concaved portion 63 in the direction of rotation of the secondary transfer roller, is set so as to be greater than the maximum length of the aforementioned transfer material S in the direction of movement of the transfer material. The toner image on the intermediate transfer belt 40 can thereby be reliably transferred, even onto the aforementioned transfer material S having the maximum length in the direction of movement of the transfer material.

A tension roller 43 is provided at a position opposite the secondary transfer roller 61, with the intermediate transfer belt 40 interposed therebetween. The tension roller 43 is urged towards the secondary transfer roller 61 by an urging member 43*a*, which is a contacting/separating part made from an elastic member. A tension-applying member 42*a* causes the driven roller 42 to press the intermediate transfer belt 40 from the inside to the outside. As a result, tension is applied on the intermediate transfer belt 40 from the inside to the outside at all times.

The secondary transfer roller 61 is formed so as to have a larger diameter than the tension roller 43, a substantively large weight, and a large inertial energy. Securing the secondary transfer roller 61 having a large diameter to a first frame 101, which is a support member; and causing the tension roller 43, which has a small diameter and a substantively small weight, to move and come into contact with the secondary transfer roller 61, makes it possible to reduce the inertial force when contact occurs. The secondary transfer roller 61 is rotatably driven by a driving motor (not shown), which is a driving part.

The secondary transfer roller 61 and the gate rollers 71, 71' are supported by the first frame 101. The photoreceptors 10Y, 10M, 10C, 10K, the belt-driving roller 41, the driven roller 42, the tension roller 43, the developing devices 30Y, 30M, 30C, 30K (not shown), and other components are supported by a second frame 102.

The secondary transfer roller 61 and the gate rollers 71, 71' supported by the same first frame 101 reduce any changes in the relative positions of the secondary transfer roller 61 and the gate rollers 71, 71' due to impact, vibration, or other causes; causes the entry of the transfer material S delivered from the gate rollers 71, 71' to become stable; and makes it possible to grip, in a stable manner, the transfer material S using the gripper 64 provided in the concaved portion 63 of the secondary transfer roller 61.

Next, a description will be given for detection of the rotation position of the secondary transfer roller 61 according to the invention.

The secondary transfer roller 61 is provided with a detected member 91 that is supported coaxially with respect to the secondary transfer roller 61, where the detected member 91 rotates integrally with the secondary transfer roller 61; and a detected part 90 having a slit 92 formed on the detected member 91.

A case or another element (not shown) for supporting the secondary transfer roller 61 is provided with a rotation detection part 95 having a sensor support member 96 and a sensor 97 for detecting the passing of the slit 92. The sensor 97 has a light-emitting part and a light-receiving part on both sides with the detected member 91 positioned therebetween. When the slit 92 passes between the light-emitting part and the light-receiving part, the light-receiving part receives light emitted by the light-emitting part and thereby detects the rotation position.

When the sensor 97 detects the slit 92, a control part (not shown) controls the timing, and commences exposure of the exposure units 12 and delivery of the transfer material by the gate rollers 71, 71'.

Next, a description will be given for the operation timing of the rotation detection part 95 and the gate rollers 71, 71' according to an embodiment of the invention. In the embodiment of the invention, timing is set so that the sensor 97 detects the slit 92 when the secondary transfer roller 61 and the intermediate transfer belt 40 are in contact with each other without the transfer material S being interposed therebetween.

When the secondary transfer roller 61 rotates and the sensor 97 detects the slit 92, a signal transmitted from the control part drives the gate rollers 71, 71' after a predetermined period as shown in FIG. 2. The gate rollers 71, 71' start to rotate from a state of sandwiching a front end S1 of the transfer material S, and commence delivery of the transfer material S.

At this time, the tension roller 43 is pressed by the urging member 43*a* towards the secondary transfer roller 61. However, the tension roller 43 is in contact with the outer circumference 61*b* of the secondary transfer roller 61 other than the concaved portion 63 with the intermediate transfer belt 40 interposed therebetween, and therefore does not move position.

Also, the sensor 97 detects the slit 92 when the secondary transfer roller 61 and the intermediate transfer belt 40 are in contact with each other without the transfer material S being interposed therebetween. Since a setting is thus made so that the sensor 97 detects the slit 92 when the secondary transfer roller 61 and the intermediate transfer belt 40 are in contact with each other without the transfer material S being interposed therebetween, the rotation position of the secondary transfer roller 61 is detected in a stable state, and it becomes possible to perform a transfer and form an image in a satisfactory manner.

The transfer material S is then delivered by the gate rollers 71, 71' as shown in FIG. 3. At this time, the secondary transfer roller 61 rotates, and the first boundary 61*c* between the outer circumference 61*b* and the concaved portion 63 of the secondary transfer roller 61 comes to a position of being in contact with the tension roller 43.

The tension roller 43 is urged by the urging member 43*a*. However, the tension roller 43 does not move while in a state of being in contact with the outer circumference 61*b* of the secondary transfer roller 61. However, in a state in which the tension roller 43 is opposite the concaved portion 63 of the secondary transfer roller 61, no contact is made with respect to the outer circumference 61*b*. Therefore, when the tension roller 43 passes the first boundary 61*c*, it is urged to move towards the secondary transfer roller by the urging force from the urging member 43*a*. There is a risk of this force, which is acting to move the tension roller 43, acting as an impulse and generating a vibration in the intermediate transfer belt 40.

Since the tension-applying member 42*a* causes the driven roller 42 to press the intermediate transfer belt 40 from the inside to the outside, tension is applied on the intermediate transfer belt 40 from the inside to the outside at all times. Therefore, the impact when the tension roller 43 passes the first boundary 61*c* can be cushioned using the driven roller 42, and the driven roller 42 is capable of reducing the vibration in the intermediate transfer belt 40.

Also, the gripper 64 is preferably set so that the gripper 64 in an opened state does not exceed a hypothetical outer circumferential line of the outer circumference 61*b* of the secondary transfer roller 61 in the concaved portion 63. This configuration makes it possible to prevent the gripper 64 from touching the intermediate transfer belt 40.

The transfer material S is then further delivered by the gate rollers 71, 71', and the front end 51 arrives at the gripper 64 provided in the concaved portion 63, as shown in FIG. 4. The gripper 64 rotates about the rotation shaft 64*a*, and the gripper 64*b* lands on the gripper support part 61*a*, whereby the transfer material S is sandwiched.

In this state, the tension roller 43 is opposite the concaved portion 63 of the secondary transfer roller 61, and is no longer in contact with the outer circumference 61*b*. Therefore, the concaved portion 63 is urged to move towards the secondary transfer roller by the urging force from the urging member 43*a*. Therefore, tension is applied to the intermediate transfer belt 40 from the inside to the outside at all times, and it is possible to reduce the movement of the tension roller 43, even during a state in which the tension roller 43 is opposite the concaved portion 63.

Then, as shown in FIG. 5, the secondary transfer roller 61 rotates further, and the transfer material S is delivered by the gate rollers 71, 71'. At this time, the second boundary 61*d* between the outer circumference 61*b* and the concaved portion 63 of the secondary transfer roller 61 comes to a position of being in contact with the tension roller 43.

In a state in which the tension roller 43 is opposite the concaved portion 63 of the secondary transfer roller 61, no contact is present with respect to the outer circumference 61*b*, and the tension roller 43 is therefore urged to move towards the secondary transfer roller by the urging force from the urging member 43*a*. However, since the tension-applying member 42*a* causes the driven roller 42 to press the intermediate transfer belt 40 from the inside to the outside, tension is applied to the intermediate transfer belt 40 from the inside to the outside at all times, and the intermediate transfer belt 40 reduces the movement of the tension roller 43.

When the tension roller 43 passes the second boundary 61*d* from this state, the tension roller 43 is subjected to a force so as to be pressed by the secondary transfer roller 61, against the urging force from the urging member 43*a*. There is a risk of this force acting as an impulse and generating a vibration in the intermediate transfer belt 40.

Since the tension-applying member 42*a* causes the driven roller 42 to press the intermediate transfer belt 40 from the inside to the outside, tension is applied on the intermediate transfer belt 40 from the inside to the outside at all times. Therefore, the impact when the tension roller 43 passes the second boundary 61*d* can be cushioned using the driven roller 42, and the driven roller 42 is capable of reducing the vibration in the intermediate transfer belt 40.

Subsequently, when the transfer material S passes through the nip part between the secondary transfer roller 61 and the intermediate transfer belt 40, the image is transferred from the intermediate transfer belt 40 onto the transfer material S. The gate rollers 71, 71' may continue rotating at this time.

Figure 6:
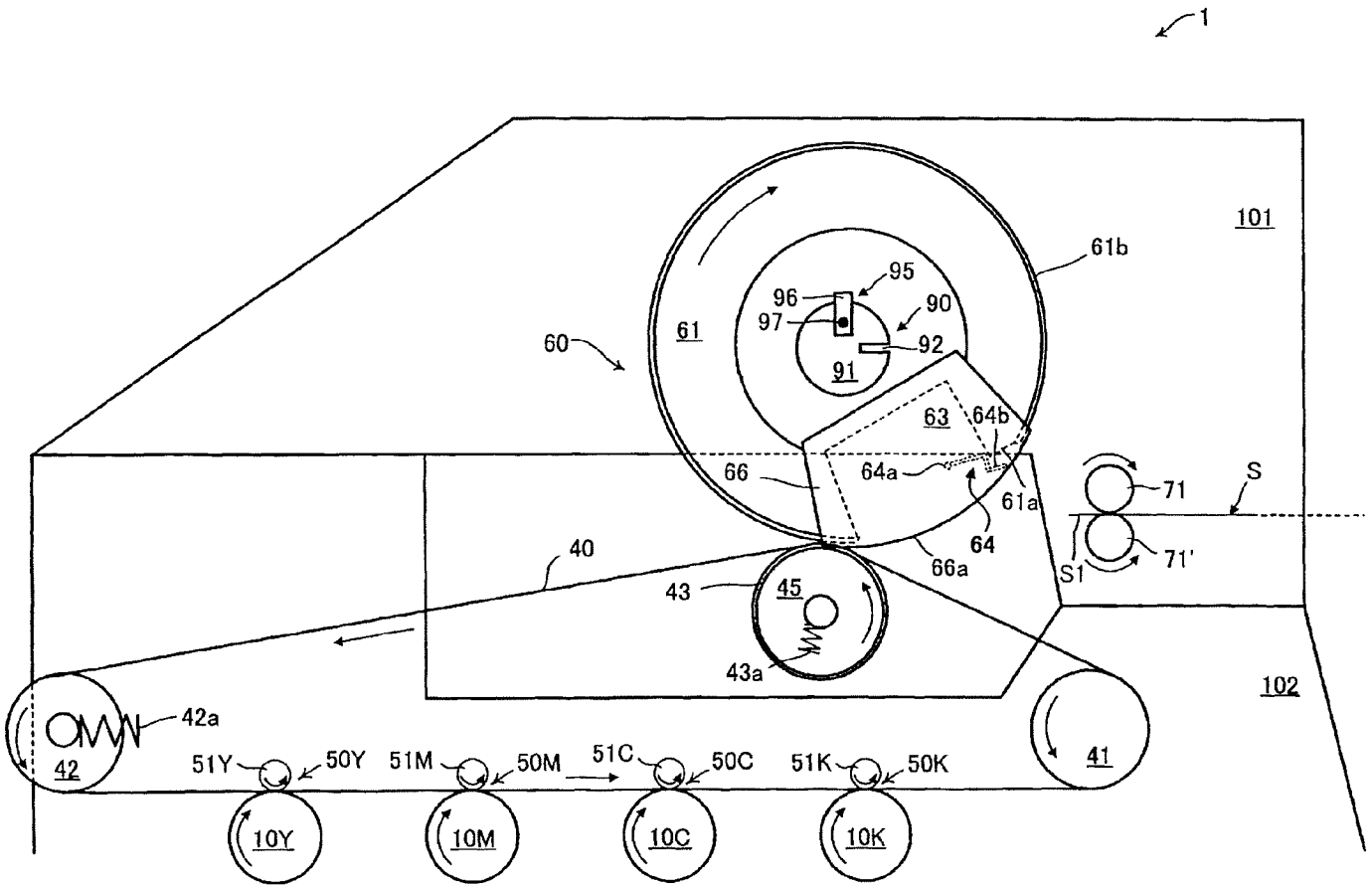
FIG. 6 is a drawing showing a state in which the contact member and the cylindrical member are about to come into contact with each other according to a second embodiment.
Figure 7:
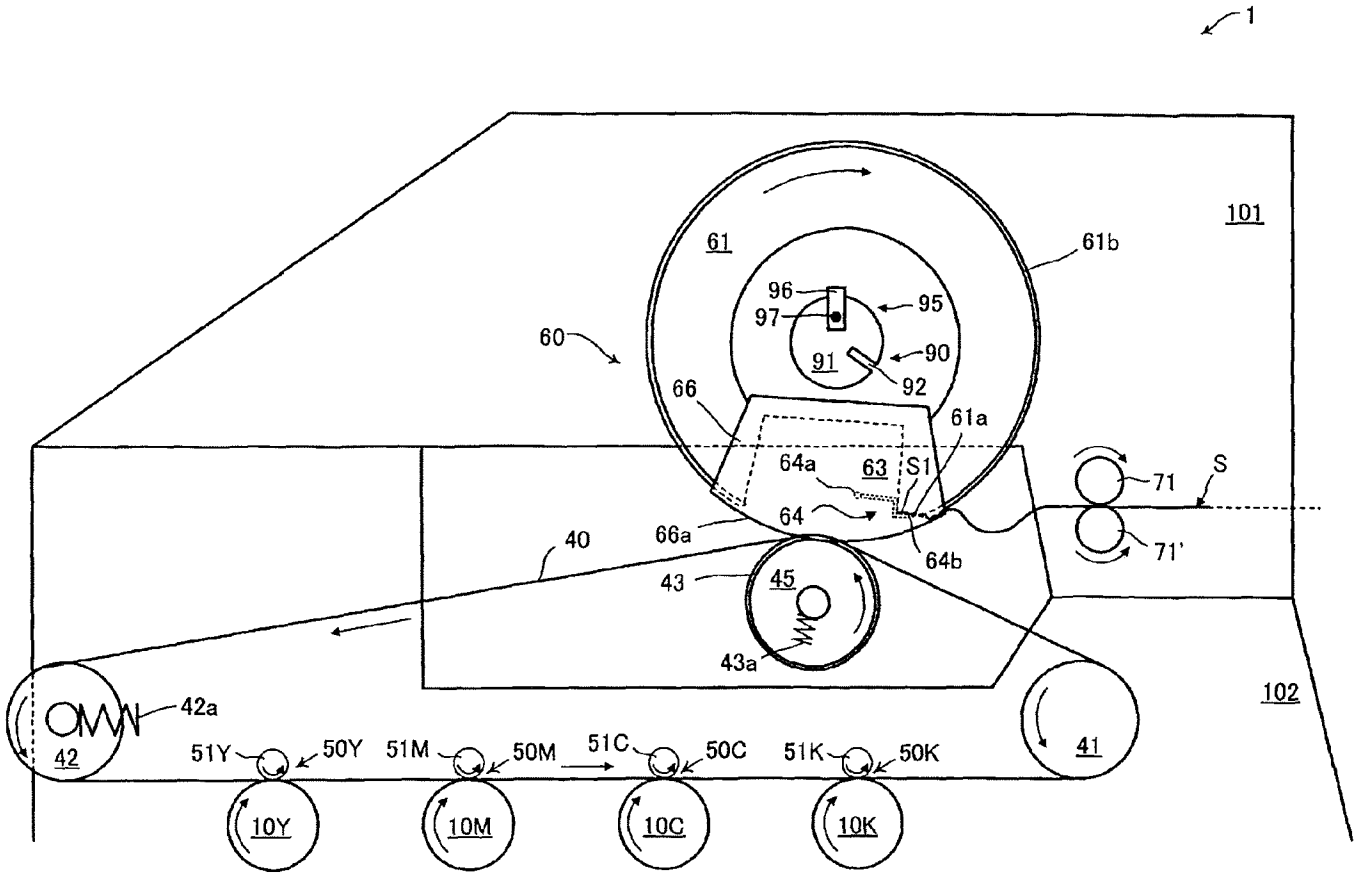
FIG. 7 is a drawing showing a state in which a concaved portion of the secondary transfer roller and the tension roller are opposite each other and the contact member and the cylindrical member are in contact with each other according to the second embodiment.
Figure 8:
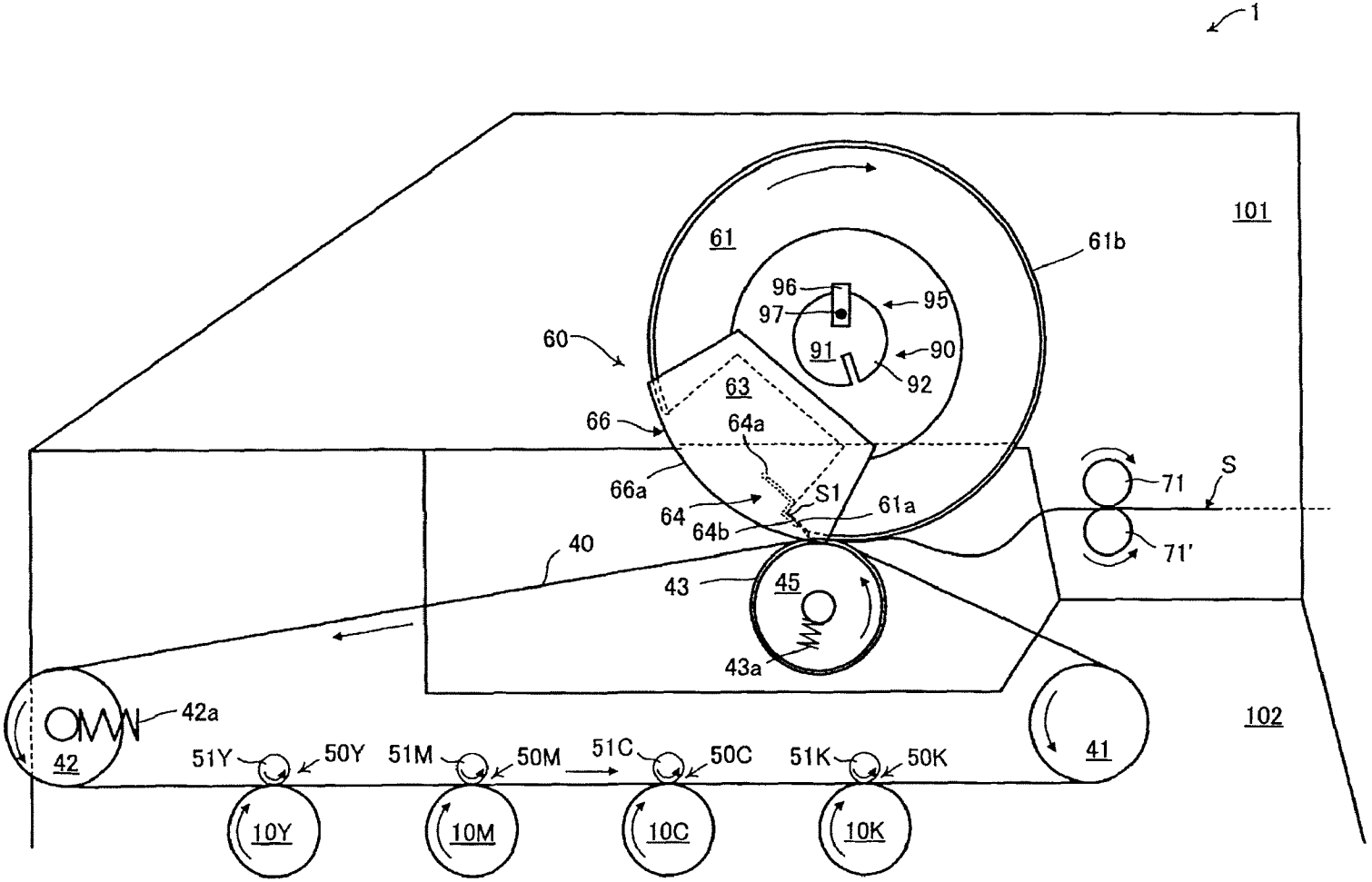
FIG. 8 is a drawing showing a state in which the contact member and the cylindrical member are no longer in contact with each other and are diverging according to the second embodiment.

Next, a description will be given for a configuration of the secondary transfer part 60 and other components according to a second embodiment. FIGS. 6 through 8 are expanded views of the vicinity of the secondary transfer part 60 according to the second embodiment. FIG. 6 is a drawing showing a state in which a contact member 66 and a cylindrical member 45 are about to come into contact with each other; FIG. 7 is a drawing showing a state in which the concaved portion 63 of the secondary transfer roller 61 and the tension roller 43 are opposite each other and the contact member 66 and the cylindrical member 45 are in contact with each other; and FIG. 8 is a drawing showing a state in which the contact member 66 and the cylindrical member 45 are no longer in contact with each other and are diverging.

In the second embodiment, the contact member 66 is provided on the outside in the axial direction of the concaved portion 63 of the secondary transfer roller 61, and the cylindrical member 45 for coming into contact with the contact member 66 is provided on the outside in the axial direction of the tension roller 43. The cylindrical member 45 and the contact member 66 form an adjusting part.

The contact member 66 has an arc part 66*a* that is concentric with respect to the outer circumference 61*b* of the secondary transfer roller 61, and that has a diameter that is slightly larger than that of the outer circumference 61*b*. The cylindrical member 45 is coaxial with respect to the tension roller 43, and has a diameter that is smaller than that of the tension roller 43. Also, the cylindrical member 45 is urged, with the tension roller 43, towards the secondary transfer roller 61. The secondary transfer roller 61 and the tension roller 43 come into contact with each other, and thereby adjust the distance between the rotation shaft of the secondary transfer roller 61 and the rotation shaft of the tension roller 43 to a predetermined distance. The adjusting part may also be referred to as a restricting part for restricting the center distance between the center of rotation of the secondary transfer roller 61 and the center of rotation of the tension roller 43 to a predetermined distance. In this instance, the cylindrical member 45 and the contact member 66 form the restricting part.

Other structures are identical to the first embodiment, and a description will therefore not be provided.

When the secondary transfer roller 61 rotates and the sensor 97 detects the slit 92, the gate rollers 71, 71' are driven after a predetermined period. The gate rollers 71, 71' start to rotate from a state of sandwiching the front end S1 of the transfer material S, and commence delivery of the transfer material S.

Subsequently, when the secondary transfer roller 61 rotates further, the contact member 66 and the cylindrical member 45 come into contact with each other as shown in FIG. 6. Contact between the contact member 66 and the cylindrical member 45 is configured so as to start in a state in which the outer circumference 61*b* of the secondary transfer roller 61 and the outer circumference of the tension roller 43 are in contact with each other, or specifically, in a state before the outer circumference of the tension roller 43 is opposite the concaved portion 63. Specifically, the arc part 66*a* of the contact member 66 is set longer than the concaved portion 63 in the circumferential direction of the secondary transfer roller 61 so as to have a portion in which the contact member 66 and the outer circumference 61*b* of the secondary transfer roller 61 overlap when viewed from the axial direction.

The length in the radial direction from the arc part 66*a* of the contact member 66 to the outer circumference 61*b* of the secondary transfer roller 61 is equal to or greater than the length from the outer circumference of the cylindrical member 45 to the outer circumference of the tension roller 43, i.e., the difference in diameter between the cylindrical member 45 and the tension roller 43. Therefore, it becomes possible to reduce the impact that occurs when the contact member 66 and the cylindrical member 45 come into contact with each other. Also, even if a certain amount of impact causes a vibration, since the tension-applying member 42*a* causes the driven roller 42 to press the intermediate transfer belt 40 from the inside to the outside, tension is applied to the intermediate transfer belt 40 from the inside to the outside at all times, and it is possible to reduce the vibration.

Next, the transfer material S is further transported by the gate rollers 71, 71', and the front end 51 arrives at the gripper 64 provided in the concaved portion 63, as shown in FIG. 7. The gripper 64 rotates about the rotation shaft 64*a*, and the gripper 64*b* lands on the gripper support part 61*a*, whereby the transfer material S is sandwiched.

In this state, the tension roller 43 is opposite the concaved portion 63 of the secondary transfer roller 61, and is no longer in contact with the outer circumference 61*b*. However, since the contact member 66 and the cylindrical member 45 are in contact with each other, the tension roller 43 is unable to move towards the secondary transfer roller 61. Therefore, it becomes possible to prevent the gripper 64 and the intermediate transfer belt 40 from touching each other.

Subsequently, when the secondary transfer roller 61 rotates further, the contact member 66 and the cylindrical member 45 diverge as shown in FIG. 8. The diverging of the contact member 66 and the cylindrical member 45 is configured so as to start in a state in which the outer circumference 61*b* of the secondary transfer roller 61 and the outer circumference of the tension roller 43 are in contact with each other, or specifically, in a state after the outer circumference of the tension roller 43 is opposite the concaved portion 63. Specifically, the arc part 66*a* of the contact member 66 is set longer than the concaved portion 63 in the circumferential direction of the secondary transfer roller 61 so as to have a portion in which the contact member 66 and the outer circumference 61*b* of the secondary transfer roller 61 overlap when viewed from the axial direction.

Impact when the contact member 66 and the cylindrical member 45 diverge can be reduced, in a manner similar to that when they come into contact with each other.

Figure 9:
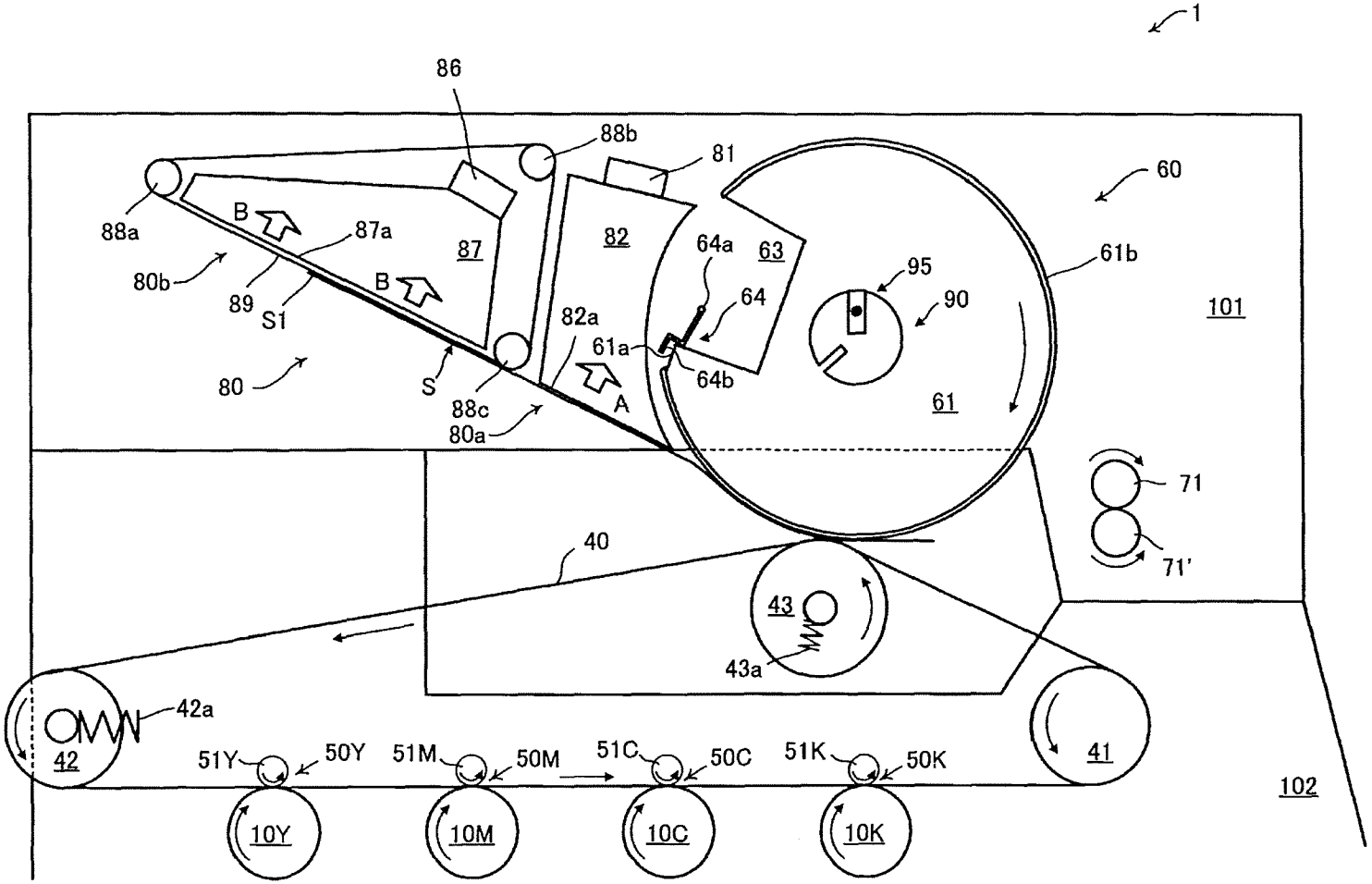
FIG. 9 is an expanded view of the vicinity of the secondary transfer roller according to a third embodiment.

Next, a description will be given for the configuration of the secondary transfer part 60 and other components according to the third embodiment. FIG. 9 is an expanded view of the surroundings of the secondary transfer roller 60 according to the third embodiment.

In the third embodiment, there is provided a transporting part 80 for transporting the transfer material S, onto which an image has been transferred at the secondary transfer part 60.

As shown in FIG. 9, the transporting part 80 has a first transporting part 80*a* and a second transporting part 80*b*.

The first transporting part 80*a* has a first airflow generating part 81 for generating an airflow, and a first casing part 82, which has a first suction surface 82*a*, which is a suction guide part for using the airflow generated by the first airflow generating part 81 to suction the transfer material S. The second transporting part 80*b* has a second airflow generating part 86 for generating an airflow; a second casing part 87, which has a second suction surface 87*a*, which is a suction guide part for using the airflow generated by the second airflow generating part 86 to suction the transfer material S; a transporting belt-driving roller 88*a* and transporting belt-tension rollers 88*b*, 88*c* provided around the second casing part 87; and a transporting belt 89 rolled onto the transporting belt-driving roller 88*a* and the transporting belt-tension rollers 88*b*, 88*c*.

The transporting part 80 is supported by the first frame 101, which is the same support member as that for the secondary transfer roller 61 and the gate rollers 71, 71'.

The front end S1 of the transfer material S, which has been gripped in the concaved portion 63 of the secondary transfer roller 61 by the gripper 64, is released by an opening operation of the gripper 64, and transported to the transporting part 80. Then, the transfer material S is held on the suction surface 82*a*, without falling, by a suction force A from the suction surface 82*a* of the first casing part 82 generated as a result of the operation of the airflow generating part 81 of the first transporting part 80*a*; and transported along the suction surface 82*a* by the force of the sending operation from towards the secondary transfer part 60.

The front end S1 in the direction of transportation of the transfer material S, having been transported along the suction surface 82*a* of the first transporting part 80*a* by the force from an operation of sending the transfer material S from the side towards the secondary transfer part 60, arrives at the second transporting part 80*b*. Next, the transfer material S is suctioned towards the suction surface 87*a* by a suction force B from the suction surface 87*a* of the casing part 87 generated as a result of the operation of the airflow generating part 86 of the second transporting part 80*b*. At the same time, the transfer material S proceeds along the suction surface 87*a* towards the fixing unit and other components (not shown) as a result of the driving force of the transporting belt-driving roller 88*a* causing a movement operation of the transporting belt 89 rolled around the transporting belt-driving roller 88*a* and the transporting belt-tension rollers 88*b*, 88*c*.

The transporting part 80, and particularly the first casing part 82, the second casing part 87, the transporting belt-driving roller 88*a*, and the transporting belt-tension rollers 88*b*, 88*c* are supported by the first frame 101, which is the same support member as that for the secondary transfer roller 61 and the gate rollers 71, 71'. Therefore, any changes in the relative positions of the transporting part 80 and the secondary transfer roller 61 in addition to the gate rollers 71, 71' due to impact, vibration, or other causes are reduced; the entry of the transfer material S transported from the gate rollers 71, 71' becomes stable; and it becomes possible to grip, in a stable manner, the transfer material S using the gripper 64 provided in the concaved portion 63 of the secondary transfer roller 61, and to transport the transfer material S to the transporting part 80 in a stable manner.

Other structures are identical to the first embodiment, and a description will therefore not be provided.

The second embodiment and the third embodiment may be combined, and a new embodiment may be configured.

What is claimed is:

1. An image-forming device comprising:

an image-carrier belt that carries and transports an image;

a belt-driving roller that causes the image-carrier belt to move, the image-carrier belt being engaged around the belt-driving roller;

a tension roller that applies a tension to the image-carrier belt, the image-carrier belt being engaged around the tension roller;

a transfer roller having a concaved portion and a gripper, the concaved portion being formed on a peripheral surface, the gripper being provided in the concaved portion and that grips a transfer material, the transfer roller coming into contact with the tension roller interposed by the image-carrier belt, and transferring the image that is carried by the image-carrier belt onto the transfer material;

a contacting/diverging part that causes the tension roller to move and that causes the transfer roller and the image-carrier belt to come into contact with or diverge from one another;

a delivery part that delivers the transfer material that is gripped by the gripper; and a support member that pivotally supports the transfer roller and supports the delivery part.

2. The image-forming device according to claim 1, further comprising a transporting part that transports the transfer material onto which the image has been transferred by the transfer roller, wherein the support member supports the transporting part.

3. The image-capturing device according to claim 2, wherein the transporting part has an airflow generating part that generates an airflow, and a suction guide part that uses the airflow generated by the airflow generating part to suction the transfer material and guide the transfer material.

4. The image-capturing device according to claim 3, wherein the transporting part has a transporting belt that uses airflow to suction and transport the transfer material that has been guided by the suction guide part, and a transporting belt tension roller that stretches the transporting belt, the transporting belt tension roller being supported by the support member.

5. The image-forming device according to claims 1, further comprising an adjusting part having a cylindrical member and a contact member, wherein the cylindrical member is supported coaxially with respect to a rotation shaft of the tension roller, the contact member is provided at an end part of the transfer roller in an axial direction, and is in contact with the cylindrical member, and the adjusting part adjusts the distance between the tension roller and the transfer roller using contact between the cylindrical member and the contact member.

* * * * *